US007562957B2

(12) United States Patent
Mills et al.

(10) Patent No.: US 7,562,957 B2
(45) Date of Patent: Jul. 21, 2009

(54) METHODS AND APPARATUS FOR BACKLIT AND DUAL-SIDED IMAGING

(75) Inventors: Michael D. Mills, Moultonboro, NH (US); Michael A. Syverson, Allenstown, NH (US)

(73) Assignee: Electronics for Imaging, Inc., Foster City, CA (US)

( * ) Notice: Subject to any disclaimer, the term of this patent is extended or adjusted under 35 U.S.C. 154(b) by 26 days.

(21) Appl. No.: 11/334,884

(22) Filed: Jan. 19, 2006

(65) Prior Publication Data

US 2006/0158473 A1 Jul. 20, 2006

Related U.S. Application Data

(63) Continuation-in-part of application No. 11/039,359, filed on Jan. 19, 2005, now abandoned.

(51) Int. Cl.
*B41J 2/205* (2006.01)

(52) U.S. Cl. ..... 347/15; 347/43; 347/21

(58) Field of Classification Search ..... 347/15, 347/40–43, 101, 104, 21, 95
See application file for complete search history.

(56) References Cited

U.S. PATENT DOCUMENTS

| | | | | |
|---|---|---|---|---|
| 4,630,076 | A | 12/1986 | Yoshinura | |
| 4,660,757 | A | 4/1987 | Hicks | |
| 5,144,328 | A | 9/1992 | Black et al. | |
| 5,795,425 | A | 8/1998 | Brault et al. | |
| 5,830,529 | A * | 11/1998 | Ross | 427/152 |
| 6,086,198 | A | 7/2000 | Shields et al. | |
| 6,102,537 | A * | 8/2000 | Kato et al. | 347/101 |
| 6,582,861 | B2 | 6/2003 | Buxbaum et al. | |
| 6,585,369 | B1 | 7/2003 | Sievert et al. | |
| 6,769,766 | B2 | 8/2004 | Suzuki et al. | |
| 6,902,249 | B2 * | 6/2005 | Suzuki et al. | 347/15 |
| 7,178,898 | B2 | 2/2007 | Hoshino | |
| 7,237,861 | B2 * | 7/2007 | Suzuki et al. | 347/15 |
| 2005/0057608 | A1 | 3/2005 | Kachi | |

FOREIGN PATENT DOCUMENTS

| | | |
|---|---|---|
| EP | 1331100 | 7/2003 |
| GB | 2389078 B | 12/2003 |

OTHER PUBLICATIONS

Rho 160/160 Plus and Rho 160W Plus Product Information. Http://www.durst-online.com/uk/mitte_produkte_neu.asp?pid=1&hid=1, 6pp. (Nov. 22, 2004).

* cited by examiner

*Primary Examiner*—Thinh H Nguyen
(74) *Attorney, Agent, or Firm*—Michael A. Glenn; Glenn Patent Group

(57) ABSTRACT

Methods and apparatus for backlit and dual-sided imaging are described. A print head array is provided comprising first and second print heads arranged along a single print head axis. The first print head is adapted to print first and second images on a substrate, and the second print head is adapted to print a coating layer between the first and second images. The coating layer may comprise a specialized printing fluid such as a layer of substantially white ink. The substrate may comprise a substantially translucent or substantially clear material.

18 Claims, 8 Drawing Sheets

METHODS AND APPARATUS FOR BACKLIT AND DUAL-SIDED IMAGING

REFERENCE TO RELATED APPLICATIONS

This application is a continuation-in-part of U.S. application Ser. No. 11/039,359, filed 19 Jan. 2005.

BACKGROUND

Certain types of printing systems are adapted for printing images on large-scale print media, such as for museum displays, billboards, sails, bus boards, and banners. Some of these systems use so-called drop on demand ink jet printing. In these systems, a piezoelectric vibrator applies pressure to an ink reservoir of the print head to force the ink out through the nozzle orifices positioned on the underside of the print heads. A set of print heads are typically arranged in a row along a single axis within a print head carriage. As the carriage scans back and forth along the direction of the print head axis, the print heads deposit ink across the width of the substrate. A particular image is created by controlling the order at which ink is ejected from the various nozzle orifices.

Some of these systems use inks with different colors to create the desired image. For instance, black, yellow, cyan, and magenta colored inks are commonly employed alone or in combination to generate the image. Thus, combinations of these four colors are used to create various other colors. For instance, a green region of the image is produced by depositing a yellow layer of ink and a cyan layer of ink.

The inks used in these systems are typically "subtractive"-type inks, meaning that as ambient (i.e., white) light passes through the image, each different ink, or combination of inks, "subtracts" light of certain characteristic wavelengths, so that an observer views each respective ink or combination of inks on the substrate as having a particular color (e.g., yellow, cyan, magenta, etc.). Because of this, it is generally required that the images to be printed on a white or near-white background—such as on a white substrate—to assure that an observer will see the proper colors in the final printed image. Otherwise, colors from behind the ink pattern may interfere with the colors of the inks and distort the image seen by the observer.

Accordingly, in order to print color images on non-white substrates, such as colored or transparent substrates, it is typically necessary to deposit a layer of white ink to serve as a backdrop for the color inks. For instance, to print a multi-colored image on a black or colored substrate, the area of the substrate on which the image is to be printed is first pre-coated with a layer of white ink, and then the image is printed on top of the white pre-coat layer. The white background layer prevents the colors in the image from being distorted by the black or colored substrate.

When printing on a transparent substrate, the colored inks are typically applied on the reverse side of the substrate, so that the image may be viewed through the front side of the substrate. Then, a layer of white ink is printed over the colored ink pattern in what is known as a "post-coating" step. The white "post coat" layer serves as a backdrop so that the colors of the image appear properly when viewed from the front side of the transparent substrate. Typically, the transparent substrate is then laminated onto a second transparent substrate, such as a window, so that the color image is protected between the two transparent substrates.

One drawback to the existing techniques for ink-jet printing on non-white substrates is that they require a separate "pre-coating" or "post-coating" step. These additional steps may be performed on a separate printing system configured to print a layer of white ink, but this is an extremely time-consuming and costly solution. Alternatively, there are some ink jet printing systems that are capable of performing the "pre-coating" or "post-coating" steps by providing a pair of separate, dedicated print heads for printing white ink onto the substrate. One example of such a system is the Rho 160W printer from Durst Phototechnik AG, of Brixen, Italy. In these systems, dedicated print heads are located adjacent to the leading and trailing edges of the main print head array for depositing a layer of white ink onto the substrate either prior to, or subsequent to, the main printing operation. An example of this type of printing system is shown schematically in FIG. 3. One disadvantage to this type of system is that the print head carriage must be made larger to accommodate the dedicated pre-coat and post-coat print heads, which are located outside of the main axis of colored ink print heads. Also, these extra print heads are relatively expensive, and may add significant costs to the printing system.

SUMMARY

Methods and apparatus in accordance with this invention use an array of print heads arranged along a single print head axis to print images and a coating layer on a substrate during a single printing step (i.e., without requiring separate pre-coat or post-coat processing). In particular, print apparatus in accordance with this invention deposit a first image layer on a substrate, then deposit a coating layer over the first image layer, and then deposit a second image layer over the coating layer. The coating layer may comprise a specialized printing fluid such as a substantially white ink. The substrate may be substantially translucent or substantially clear material, such as glass or plastic media. Such printing techniques may be useful for backlit imaging and dual-sided imaging.

Apparatus and methods in accordance with this invention advantageously use a conventional print head array, in which the print heads are arranged along a single print head axis. In an exemplary embodiment, the print head array is housed in a carriage that scans across the width of a substrate as the substrate advances beneath the print heads. The print head array may include three groups of print heads. A first group of print heads may be used to print multi-colored inks onto the substrate to form a first image layer. A second group of print heads may be used to print a specialized printing fluid, such as substantially white ink, over the first image layer to form a coating layer. A third group of print heads may be used to print multi-colored inks over the coating layer to form a second image layer. The first and second image layers may be the same image, or may be different images.

BRIEF DESCRIPTION OF THE DRAWINGS

Features of the present invention may be more clearly understood from the following detailed description considered in conjunction with the following drawings, in which the same reference numerals denote the same elements throughout, and in which.

DETAILED DESCRIPTION

Figure 1:
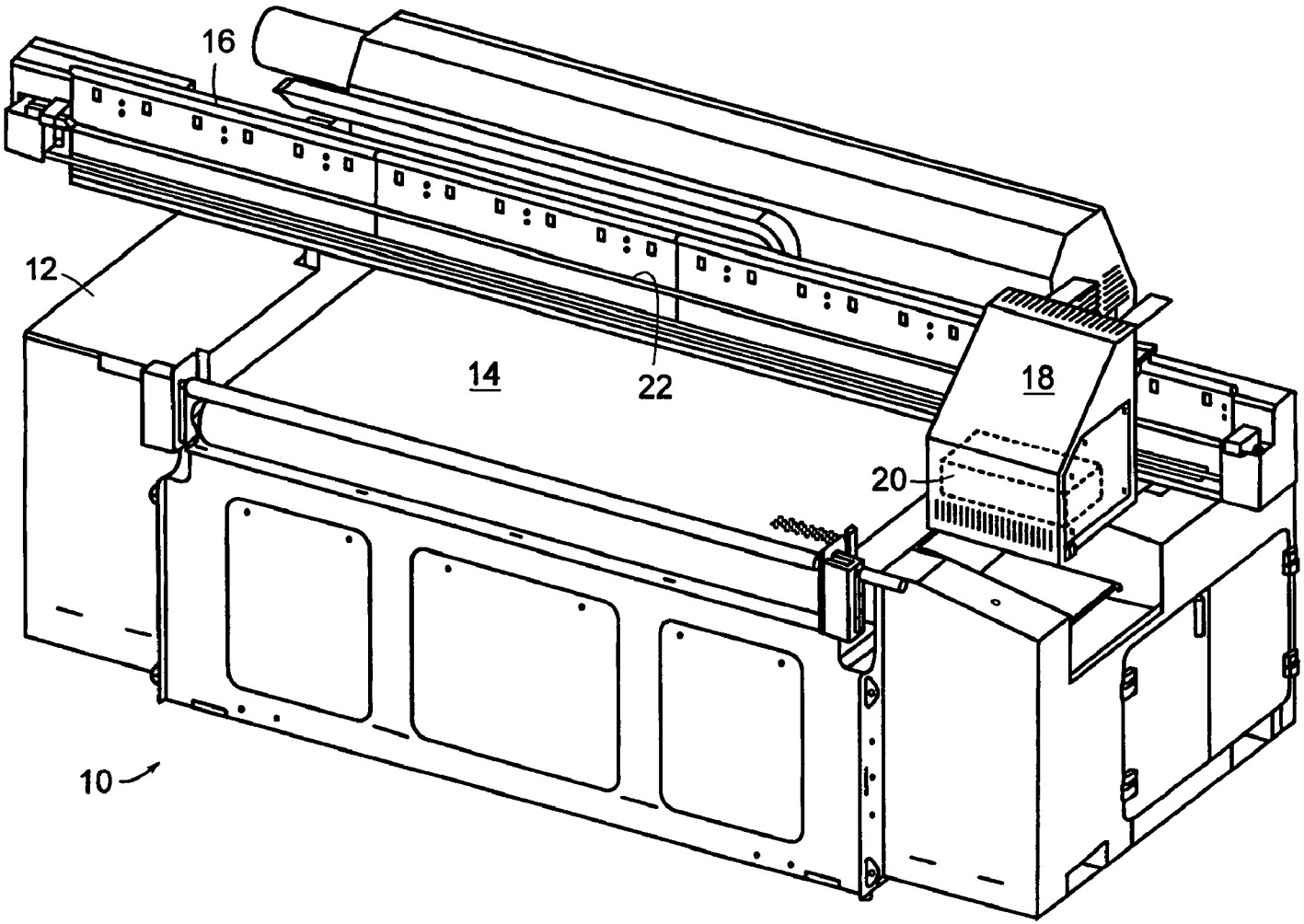
FIG. 1 is a perspective view of a printing system in accordance with the invention.

Referring now to FIG. 1, an exemplary printing system in accordance with this invention is described. In particular, printing system 10 includes a carriage 18 that holds a series of ink jet print heads 20 configured for printing images on a variety of substrates. Exemplary substrates include glass and plastic substrates. The inks deposited may be solvent-based inks, or radiation (e.g., ultra-violet "UV") curable inks used, for example, in printing systems described in Arthur L. Cleary et al. U.S. Pat. No. 6,457,823 ("Cleary") and Stephen J. Mills et al. U.S. application Ser. No. 10/172,761, filed 13 Jun. 2002 ("Mills") the disclosures of which are incorporated herein by reference in their entirety.

In addition to the carriage 18, the printing system 10 includes a base 12, a transport belt 14 that moves a substrate positioned on top of the belt 14 through the printing system 10, and a rail system 16 attached to the base 12. The carriage 18 is attached to a belt 22 which is wrapped around a pair of pulleys positioned on either end of the rail system 16. A carriage motor is coupled to one of the pulleys and rotates the pulley during the printing process. Accordingly, as the transport belt 14 intermittently moves the substrate 1002 (see FIG. 2) underneath the carriage 18, and hence the series of print heads 20, the pulleys translate the rotary motion of the motor to a linear motion of the belt 22 thereby causing the carriage 18 to traverse back and forth along the rail system 16 across the substrate 1002 as the series of ink print heads 20 deposit ink onto the substrate 1002. More particularly, as illustrated in FIG. 2, the carriage 18 moves back and forth as indicated by the arrow A as the substrate 1002 moves intermittently in the direction of arrow B underneath the print heads 20.

Figure 2:
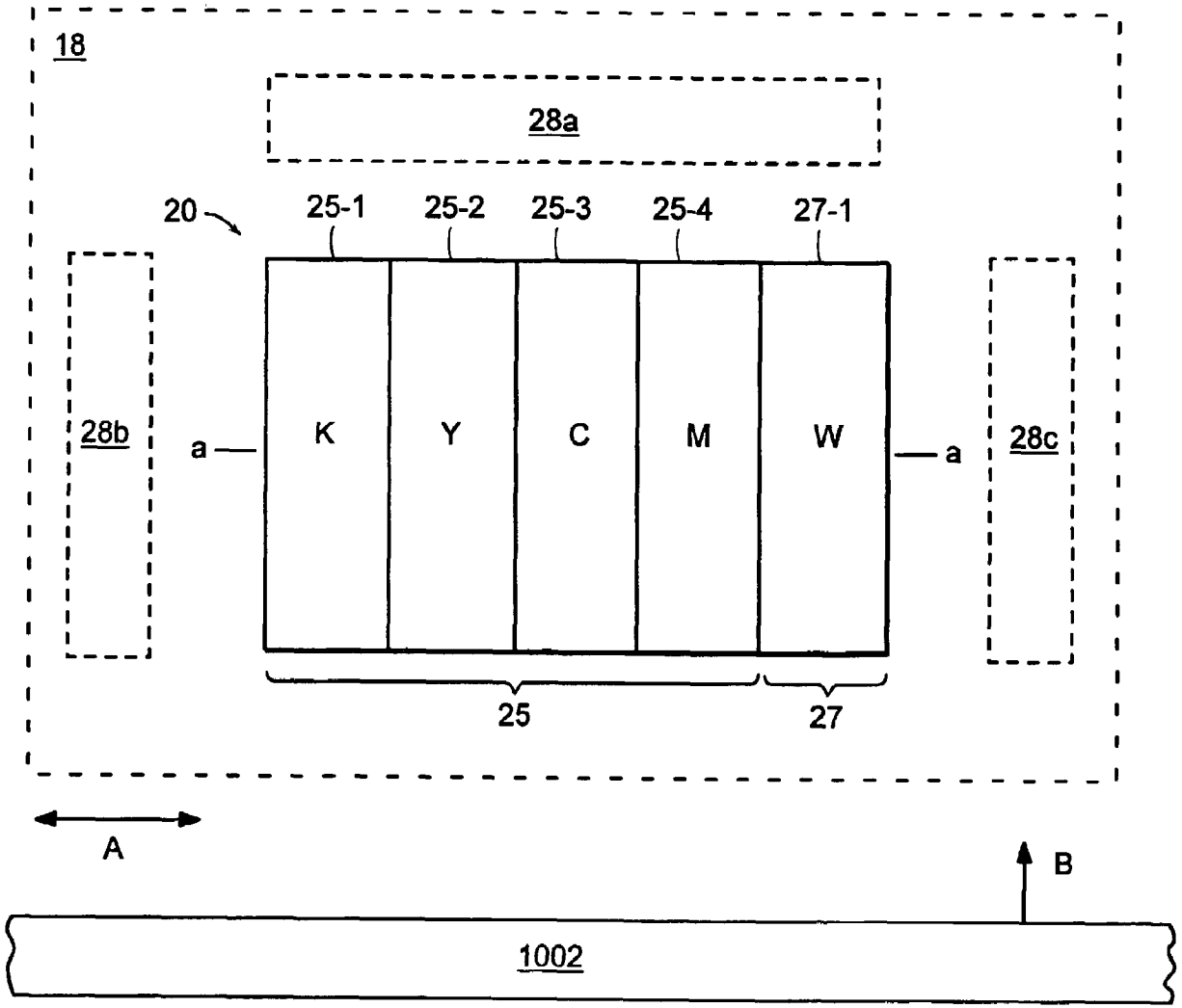
FIG. 2 is a top view of a carriage of the printing system of FIG. 1 holding a series of print heads.

Referring now to FIG. 2, an exemplary arrangement of print heads 20 is described. Print heads 20 generally include two groups of print heads 25, 27, comprising two separate printing channels. The first group of print heads 25, comprising the first printing channel, includes a series of print heads for printing multi-colored images using colored inks. In the embodiment shown in FIG. 2, the first group of print heads 25 includes four print heads, 25-1, 25-2, 25-3 and 25-4, for printing black (K), yellow (Y), cyan (C), and magenta (M) inks, respectively. In practice, the first group of print heads 25 typically will include more than four print heads. For example, the first group of print heads 25 may include eight print heads, with pairs of print heads for printing each of the black (K), yellow (Y), cyan (C), and magenta (M) inks, respectively. In other embodiments, the first group of print heads 25 may include sixteen print heads, divided into subgroups of four print heads each for printing each of the four different colored inks.

Some examples of suitable arrangements for the first group of print heads 25 are provided in Joseph A., Lahut et al. U.S. patent application Ser. No. 10/281,292, filed on Oct. 24, 2002 ("Lahut"), the disclosure of which is incorporated herein by reference in its entirety. In some embodiments, the first group of print heads 25 may include additional print heads, or subsets of print heads, for depositing more than four colors. Examples of such systems are described in Richard P. Aschman et al. U.S. Pat. No. 6,786,578 ("Aschman"), the disclosure of which is incorporated herein by reference in its entirety. Persons of ordinary skill in the art will understand that the first group of print heads 25 may include less than four print heads. In addition, persons of ordinary skill in the art will understand that the first group of print heads 25 may use less than or other than the four colors shown.

The second group of print heads 27, comprising the second printing channel, includes at least one print head 27-1 for depositing a specialized printing fluid onto the substrate. In the embodiment of FIG. 2, print head 27-1 may be used to deposit a substantially white ink (W) onto the substrate, such as utilized in a "pre-coating" or "post-coating" printing step, as described in further detail below. Persons of ordinary skill in the art will understand that the second group of print heads 27 may include more than one print head, and may included a set of print heads for depositing a printing fluid. In addition, persons of ordinary skill in the art will understand that instead of or in addition to a substantially white ink, the second group of print heads may deposit other printing fluids and combinations of such fluids onto the substrate, such as clear protective coatings, anti-graffiti coatings, adhesives, gloss coatings, and anti-gloss coatings.

As shown in FIG. 2, the first group 25 and the second group 27 of print heads are positioned adjacent to one another in carriage 18, and aligned along an axis a-a that is substantially parallel to the direction of arrow A, which is the direction of travel of carriage 18. The carriage 18 may also contain, or have associated with it, one or more radiation sources 28, such as a UV lamp or a light emitting diode ("LED") source, to partially or fully cure the inks or other printing fluids after they are deposited onto the substrate. For example, radiation source **28*a* (shown in phantom in FIG. 2) may be located adjacent to the trailing edge of the series of print heads 20 for applying radiation to the deposited fluids as the substrate 1002 moves through the system. Similarly, radiation sources 28*b*, 28*c* (shown in phantom in FIG. 2) may be positioned laterally adjacent to the series of print heads 20** for partially or fully curing the deposited fluids. Cleary and Mills describe examples of printing systems having radiation sources.

The exemplary arrangement shown in FIG. 2 advantageously allows for sequential, multi-channel printing operations using a single series of print heads 20 aligned along a single print head axis a-a. For example, apparatus and methods in accordance with this invention may perform both a "pre-coat" step when printing on non-white substrates, and a "post-coat" step when printing on transparent substrates. As described previously, both "pre-coating" and "post-coating" operations involve depositing a layer of substantially white ink to serve as a backdrop for colored inks, and thus properly balance the colors of the image, when viewed by an observer.

In a "pre-coating" step, which may be required, for instance, when printing a multi-colored image on a black or colored substrate, the area of the substrate on which the image is to be printed is first pre-coated with a layer of substantially white ink, and then the image is printed on top of the pre-coat layer. In a "post-coating" step, which may be required, for instance, when printing a multi-colored image on a transparent substrate, colored inks are typically applied first on the reverse side of the substrate, and then a layer of substantially white ink is printed over the colored ink pattern to serve as a backdrop when the color image is viewed through the front side of the substrate. In both of these operations, the color image printing and the pre- or post-coating steps are performed sequentially and independently of one another. In other words, the printed image and any coating layer(s) are not simultaneously deposited on the same portion of the substrate, or else the respective printing fluids will mix together and ruin the image as well as the coating layer(s).

Figure 3:
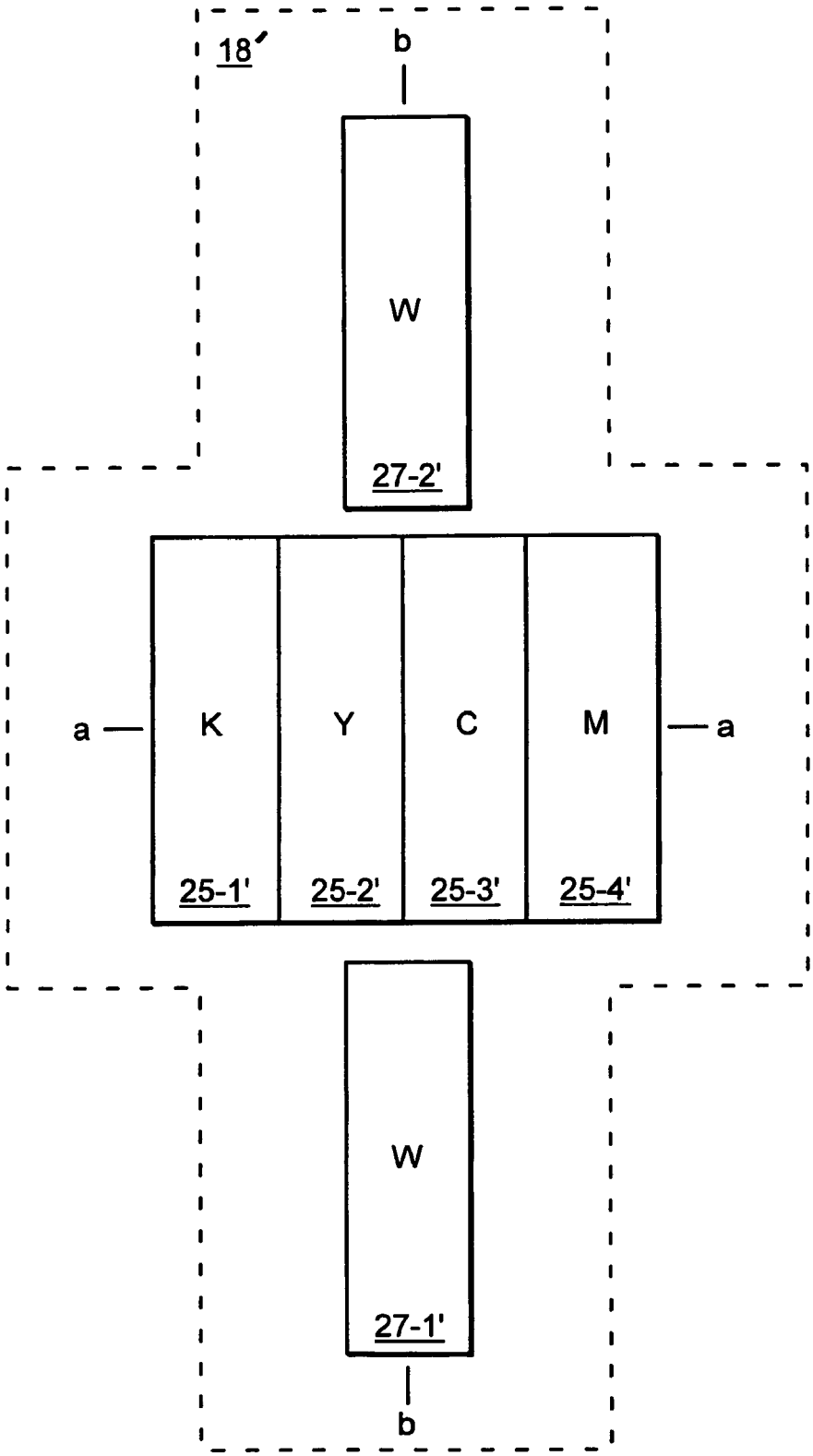
FIG. 3 PRIOR ART
FIG. 3 is a top view of a carriage holding a series of print heads according to a prior art printing system.

Referring to FIG. 3, an exemplary previously known print head arrangement for performing "re-coat" and "post-coat" printing operations is described. In this system, as in the system of FIG. 2, a print head carriage 18' holds a series of print heads 20' comprising a first group of print heads 25', including print heads 25-1', 25-2', 25-3', 25-4', for depositing colored inks (i.e., black (K), yellow (Y), cyan (C), and magenta (M), respectively) to form multi-color images on a substrate. The print heads of the first group 25' are arranged adjacent to one another in carriage 18', and aligned along an axis, a-a, that is substantially parallel to the direction of travel of carriage 18. A second group of print heads 27' consists of print heads 27-1' and 27-2' which deposit substantially white ink (W) onto the substrate in a "pre-coating" or "post-coating" operation.

Unlike the arrangement of FIG. 2, print head 27-1' is not aligned with the first group of print heads 25' along axis a-a, but instead is disposed adjacent to the leading edge of the first group of print heads 25' along axis b-b. Print head 27- 1' can only deposit fluid on the substrate prior to the formation of the color image in a pre-coat operation. Similarly, print head 27-2' is not aligned with the colored ink print heads along axis a-a, but is disposed adjacent to the trailing edge of print heads 25' along axis b-b. Print head 27-1' can only deposit fluid on the substrate subsequent to the formation of the color image in a post coat operation. Thus, in prior art systems, two separate dedicated print heads, or sets of print heads, are required to perform both pre-coating and post-coating operations. Because print heads are expensive components, this arrangement may significantly increase the printing system cost. Moreover, because the two print heads 27-1', 27-2' are not arranged in-line with the colored ink heads along axis a-a, but are instead arranged orthogonal to the other heads along axis b-b, the print head carriage 18' must be made substantially larger to accommodate these additional print heads, as well as any related components, such as a radiation source (see 28*a* in FIG. 2) for curing inks.

Figure 4:
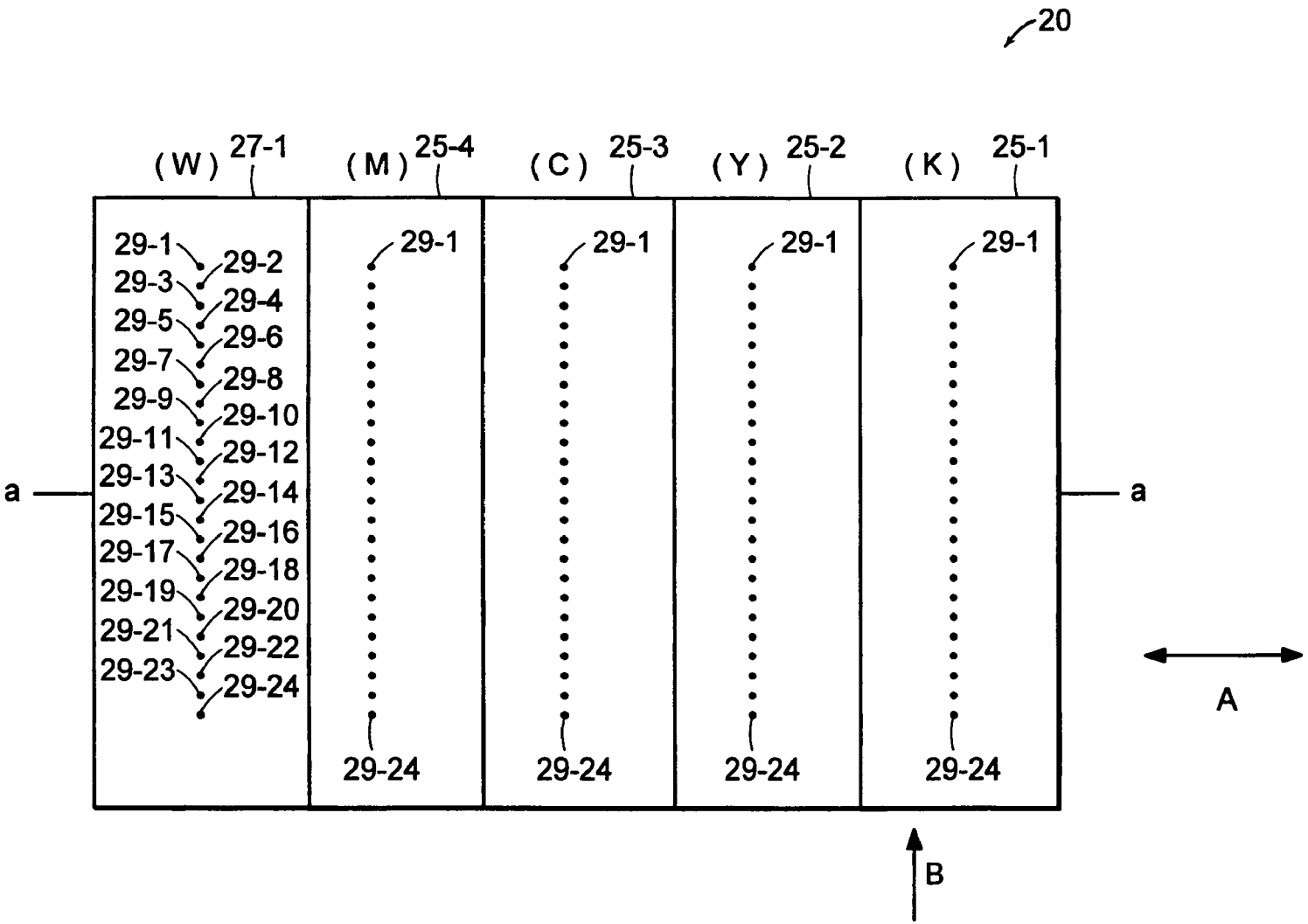
FIG. 4 is a bottom view of the carriage of FIG. 2.

By way of the arrangement illustrated in FIG. 2, and the printing method described below, the present invention is advantageously capable of performing both pre-coating and post-coating operations using a single set of print heads 20 aligned along a single axis a-a that is substantially parallel to the direction of motion of the carriage. To more clearly illustrate methods in accordance with this invention, FIG. 4 depicts the underside of the print head carriage 18 of FIG. 2. Each of the print heads 25-1, 25-2, 25-3, 25-4, 27-1 includes a row of nozzles 29 running along the length of the print head. A typical print head may include a row of 256 uniformly-spaced nozzles, with a spacing of about 4/360 of an inch between adjacent nozzles. Typically, a printing system will include a set of print heads for depositing ink of each color, with each print head in the set slightly offset from the others to increase the printing system resolution. (For instance, in a system using four print heads per ink color, an offset of 1/360th of an inch between each head provides a resolution of 360 dpi). For purposes of illustration, only five print heads are shown in FIG. 3, one for each different color ink (i.e., white (W), magenta (M), cyan (C), yellow (Y), black (K)), and each print head includes only twenty-four nozzles (indicated as 29-1 through 29-24 in FIG. 4).

During a printing operation, the substrate moves under print heads in the direction of arrow B, as the carriage 18 holding the print heads scans across the substrate in the direction of arrow A. A controller (not shown) actuates the print heads to selectively eject ink droplets from the nozzles 29 to deposit printing fluids on the substrate in a pre-determined pattern. According to the present invention, the controller is adapted to operate the printing system in the following modes: a multi-channel pre-coat mode, a multi-channel post-coat mode, a single-channel printing mode, and a multi-channel backlit imaging or dual-sided imaging mode.

Figure 5:
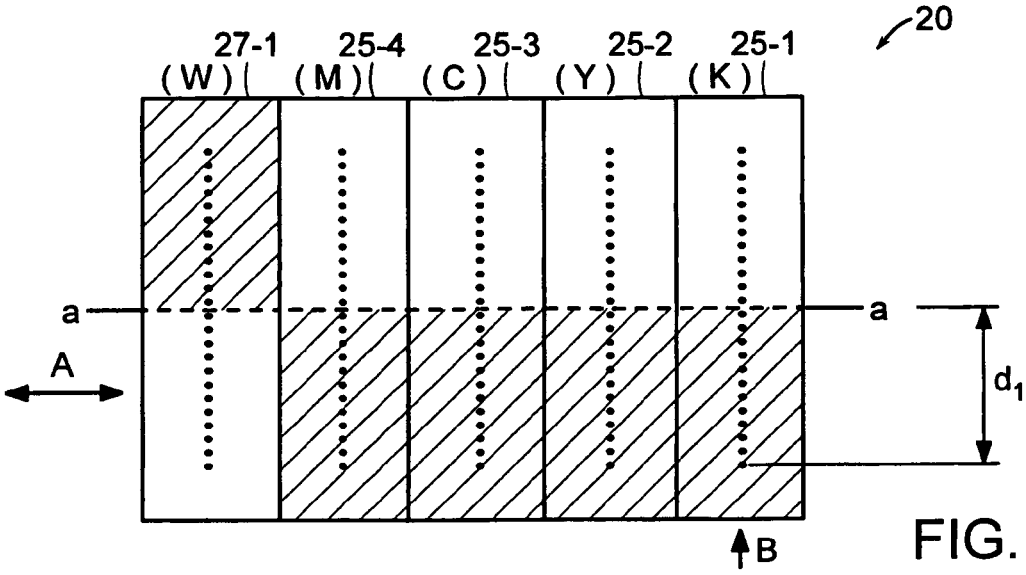
FIG. 5 is a bottom view of a series of print heads schematically illustrating a multi-channel pre-coat printing mode.

The multi-channel pre-coat mode is illustrated schematically in FIG. 5. In this mode, as the carriage 18 scans across the substrate along the direction of arrow A, the controller causes ink to eject from the nozzles of the non-hatched regions of colored ink print heads 25-1, 25-2, 25-3 and 25-4, and white ink print head 27, but no ink is ejected from the hatched regions of these heads. Accordingly, as the substrate moves along the direction of arrow B, it will first receive a layer of substantially white ink from half the nozzles of print head 27 (i.e., nozzles 29-13 through 29-24). Then, as the carriage scans back across the substrate and the substrate incremented by distance $d_1$ along direction of arrow B, the trailing nozzles (i.e., nozzles 29-1 through 29-12) of color ink print heads 25-1 through 25-4 print a color image over the layer of substantially white ink, while the leading nozzles 29-13 through 29-24 of print head 27 deposit a layer of substantially white ink on the next section of the substrate to pass under the heads.

This process is repeated until the entire pre-coating layer of white ink, and the entire color image on top of the pre-coat layer, are formed on the substrate. It will be understood that, if necessary, a radiation source may be arranged to partially or fully cure each region of white ink and/or each region of colored inks, as they are deposited. Accordingly, the printing system may simultaneously deposit both a pre-coat layer, and a color image layer on top of a pre-coat layer, using a single print head array 20 arranged along a single axis a-a. This mode is particularly advantageous for printing images on black or color substrates, where the pre-coat layer provides a substantially white backing to improve the appearance of the color image.

Persons of ordinary skill in the art will understand that although the embodiment of FIG. 5 shows half of the nozzles of print head 27 as performing the pre-coat step, and half of the nozzles of the color ink print heads 25-1 through 25-4 as performing the color printing step, this exact percentage is not necessary. What is required for the pre-coat mode is that some percentage of the nozzles adjacent to the leading edge of the substrate as it moves through the system are dedicated to the pre-coating operation, whereas the remaining nozzles are employed to print colored inks over the pre-coated sections of the substrate.

Figure 6:
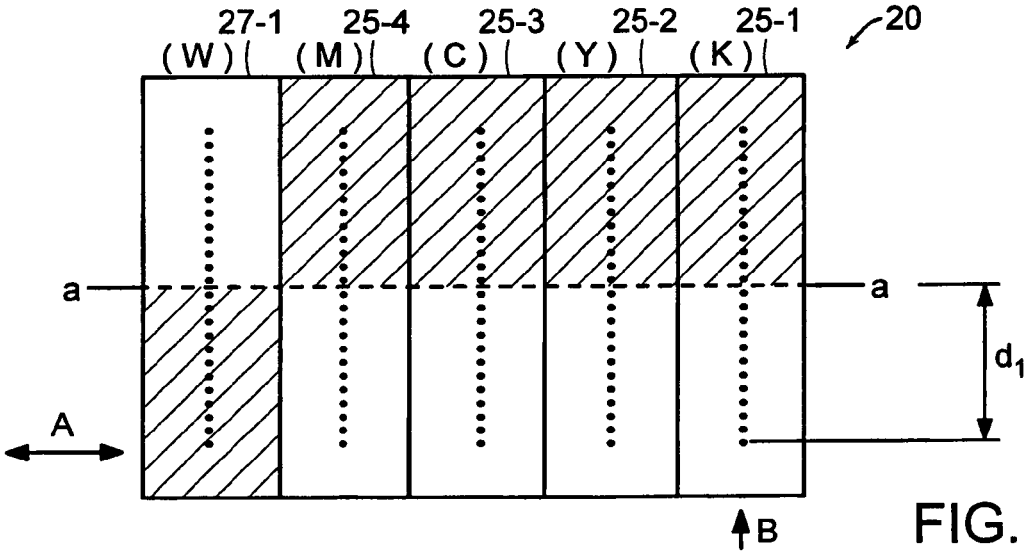
FIG. 6. is a bottom view of a series of print heads schematically illustrating a multi-channel post-coat printing mode.

The multi-channel post-coat mode is illustrated schematically in FIG. 6. In this mode, as in the pre-coat mode, as the carriage 18 scans across the substrate along the direction of arrow A, the controller causes ink to eject from the nozzles of the non-hatched regions of color ink print heads 25-1, 25-2, 25-3 and 25-4, and white ink print head 27, but no ink is ejected from the hatched regions of these heads. Note, however, that in the post-coat mode, the hatched and non-hatched regions are reversed relative to FIG. 5. Accordingly, as the substrate moves along the direction of arrow B, it will first receive a colored image from nozzles 29-13 through 29-24 of color print heads 25-1 through 25-4. Then, as the carriage scans back across the substrate and the substrate incremented by distance $d_1$ along direction of arrow B, the trailing nozzles (i.e., nozzles 29-1 through 29-12) of print head 27 deposit a layer of substantially white ink over the pattern of colored ink, while the leading nozzles 29-13 through 29-24 of the colored print heads deposit colored inks on the next section of the substrate to pass under the heads.

This process is repeated until the entire color image and the post-coat layer on top of the color image are formed on the substrate. As with the pre-coat mode of FIG. 5, persons of ordinary skill in the art will understand that, if necessary, a radiation source may be arranged to partially or fully cure each region of colored ink and/or each region of white ink, as they are deposited. Accordingly, the printing system may simultaneously deposit both a color image layer, and a white post-coat layer on top of a color image layer, using a single print head array 20 arranged along a single axis a-a. This mode is particularly advantageous for printing images on transparent substrates, where the post-coat layer provides a substantially white backing to improve the appearance of the color image when viewed through the transparent substrate.

Persons of ordinary skill in the art will understand that although the embodiment of FIG. 6 shows half of the nozzles of print heads 25-1 through 25-4 as printing colored inks, and half of the nozzles of print head 27 as performing the post-coat step, this exact percentage is not necessary. What is required for the post-coat mode is that some percentage of the color print head nozzles 25 adjacent to the leading edge of the substrate as it moves through the system are dedicated to the color printing operation, whereas the remaining percentage of nozzles of print head 27 are employed to print a post-coat layer over the color images.

Figure 7:
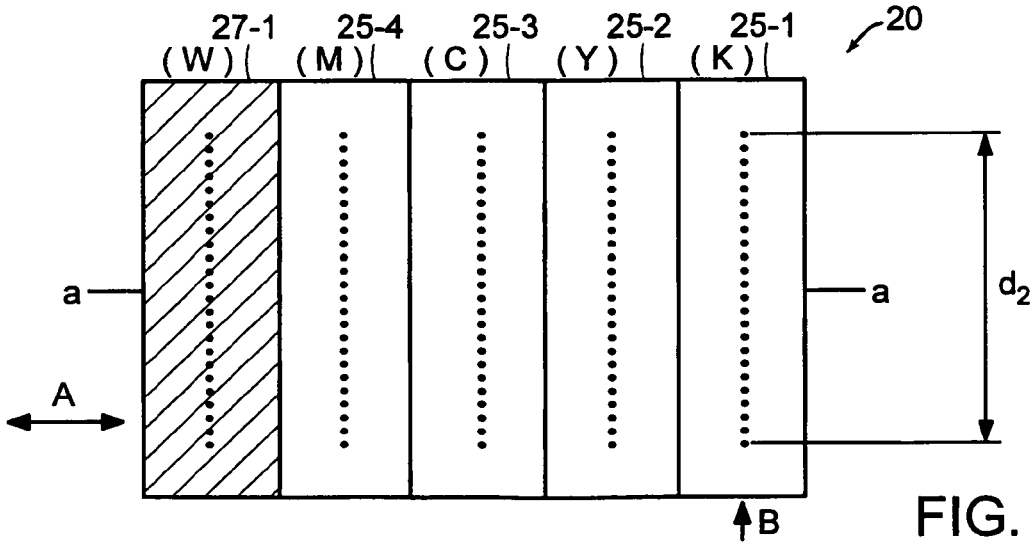
FIG. 7 is a bottom view of a series of print heads schematically illustrating a single-channel printing mode.

The single-channel printing mode is illustrated schematically in FIG. 7. In this mode, as the carriage 18 scans across the substrate along the direction of arrow A, the controller causes ink to eject from all of the nozzles of the (non-hatched) color ink print heads 25-1, 25-2, 25-3 and 25-4, but no ink is ejected from hatched print head 27. Accordingly, as the substrate moves along the direction of arrow B, and the carriage 18 scans across the substrate, the substrate may receive colored ink from any of nozzles 29-1 through 29-24 of the color print heads 25. Then, as the carriage scans back across the substrate, the substrate may be incremented by distance $d_2$ along direction of arrow B, and the color print heads may deposit a new region of colored ink on the next section of the substrate to pass under the heads. This process is repeated until the entire print image is formed on the substrate. If necessary, a radiation source may be arranged to partially or fully cure each region of colored inks as they are deposited on the substrate. Accordingly, in the single-channel mode, the printing system may utilize all the available nozzles of the color print heads to print color images in a conventional manner. This mode is useful for printing images on white or near-white substrates, where a pre-coat or post-coat layer is not necessary, and, because all of the color ink nozzles are used in this mode, the images may be printed faster than in the multi-channel modes.

Persons of ordinary skill in the art will understand that in a single-channel mode, instead of printing with the first group of color ink print heads 25, the print head could print using only the print head(s) of the second group 27, to print a layer or pattern of substantially white ink on the substrate, for example. Furthermore, the printing system may utilize the print heads of the second group 27 in conjunction with the print heads of the first group 25 to form the color image. For example, print head 27 could be selectively connected to a reservoir holding a colored ink (e.g., magenta, yellow, cyan, black, or another color) during single-channel printing operations to add an extra color print head.

In addition, although the embodiments of FIGS. 5-7 describe the substrate being incremented by a full distance of $d_1$ in the case of FIGS. 5 and 6, and $d_2$ in the case of FIG. 7, between each subsequent pass of the carriage 18, persons of ordinary skill in the art will understand that the substrate may advance in fractions of these increments for multi-pass printing operations, as are known in the art.

Moreover, although the embodiments illustrated herein show the second group of print heads 27 as comprising a single print head, persons of ordinary skill in the art will understand that additional print heads may be added to the second group. This may improve the speed of the multi-channel printing operations, and in the case of pre-coating and post-coating operations, may improve the opacity of the substantially white coating layers.

Figure 8:
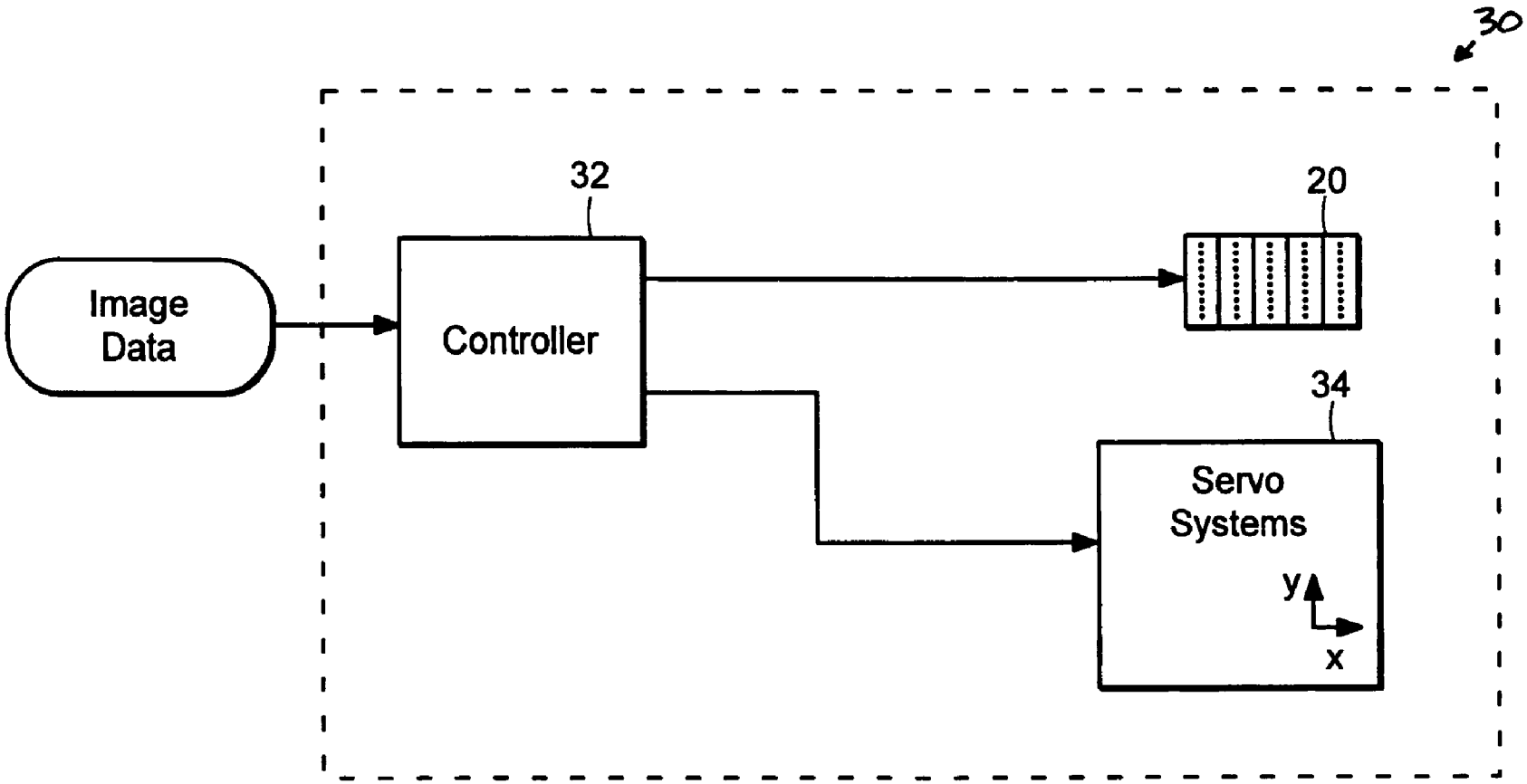
FIG. 8 is a schematic diagram of a control system of the invention.
Figure 9:
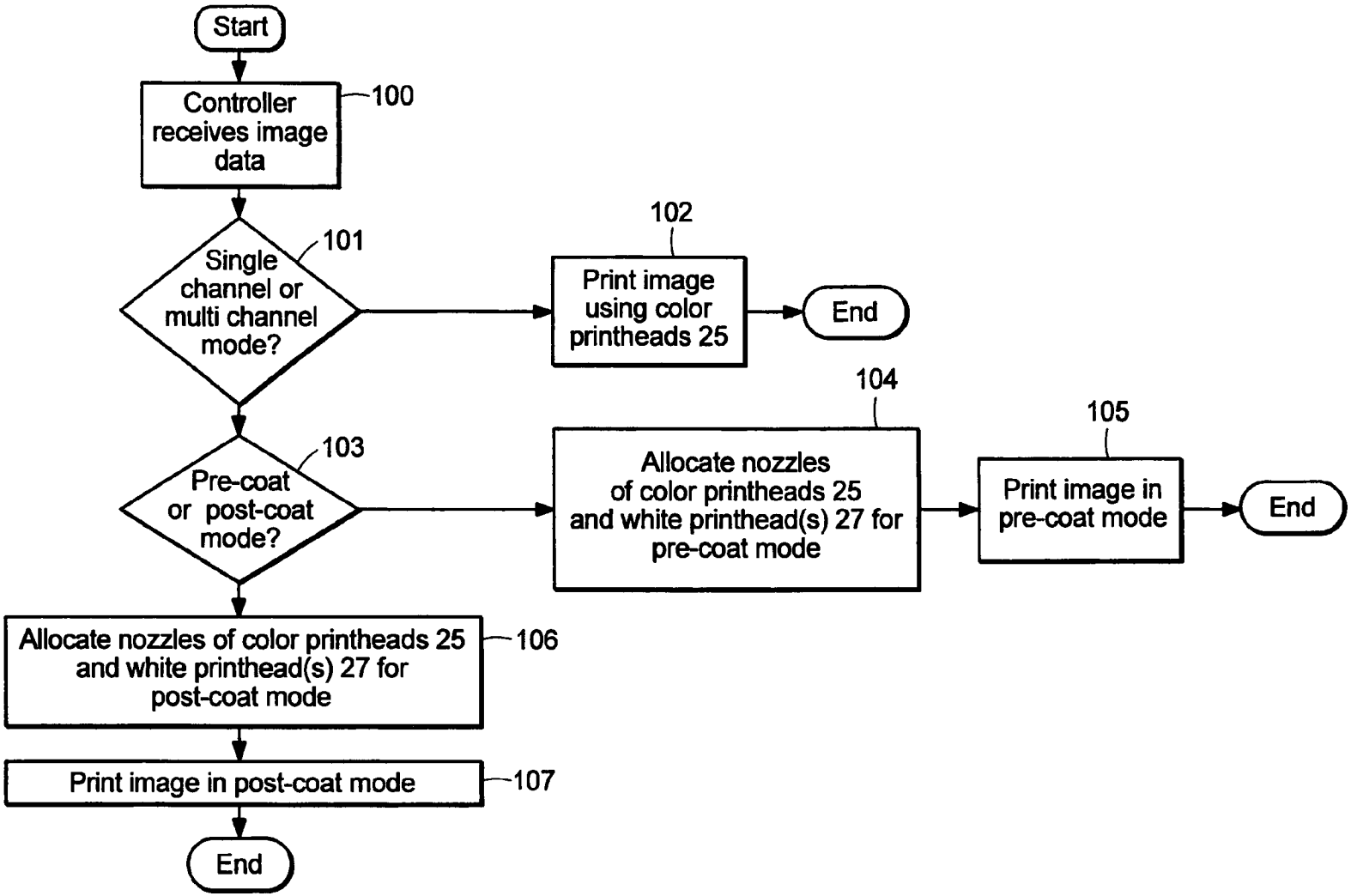
FIG. 9 is a flow diagram showing methods of printing according to the invention.

Turning now to FIGS. 8 and 9, a control system 30, and a method of printing according to the present invention are illustrated. As shown in FIG. 8, the control system 30 includes a controller 32 which controls a series of print heads 20 to eject inks from specific nozzles at specific times, and servo systems 34 for controlling the (x-y) position of the print heads relative to a substrate. The print heads 20 are made up of a first group of print heads 25 for printing colored inks, and one or more print heads 27 for depositing a specialized printing fluid, which may be, for example, substantially white ink. The controller receives image data 36 for an image to be printed on the substrate, and based upon this data, coordinates the operation of the print heads 20 and servo systems 34 to produce the desired image on the substrate.

A method of printing using control system 30 is illustrated in the flow diagram of FIG. 9. At step 100, the controller receives the image data 36 corresponding to the image to be printed on a substrate. The image data 36 may include additional information about the printing operation, such as the type of substrate being used, or whether a single-channel or multi-channel printing mode is to be employed. At step 101, the controller determines whether to print the image using a conventional, single-channel mode (such as described in connection with FIG. 7, above), or a multi-channel mode (such as described in FIGS. 5 and 6, above). If the controller determines that the image is to be printed using a conventional, single-channel mode, then the controller proceeds with a conventional printing operation at step 102, using all of the nozzles of the color ink print heads 25 of print head array 20.

If, however, the controller determines that the image is to be printed using a multi-channel mode, then at step 103, the controller determines whether to use a pre-coat mode, or a post-coat mode. If it is a pre-coat mode, then at step 104, the controller allocates a select portion of nozzles of the color ink print heads 25 for printing colored inks, and a select portion of the nozzles of the specialized fluid print head(s) 27 for printing the specialized printing fluid. In a pre-coat mode, typically about one-half of the nozzles of the specialized print head(s) 27 located closest to the leading edge of the substrate are allocated to print the specialized fluid, and about one-half of the nozzles of the color ink print heads 25 located closest to the trailing edge of the substrate are allocated to print colored ink. The controller then proceeds to step 105, and controls the print heads 20 and servo systems 34 to deposit the pre-coat and image layers.

If, however, the controller at step 103 determines that a post-coat mode is to be used, then at step 106 the controller allocates a select portion of nozzles of the color ink print heads 25 for printing colored inks, and a select portion of the nozzles of the specialized fluid print head(s) 27 for printing the specialized printing fluid. In a post-coat mode, typically about one-half of the nozzles of the color ink print heads 25 located closest to the leading edge of the substrate are allocated to print the colored inks, and about one-half of the nozzles of the specialized print head(s) 27 located closest to the trailing edge of the substrate are allocated to print the specialized fluid. The controller then proceeds to step 107, and controls the print heads 20 and servo systems 34 to deposit the image and post-coat layers.

Figure 10:
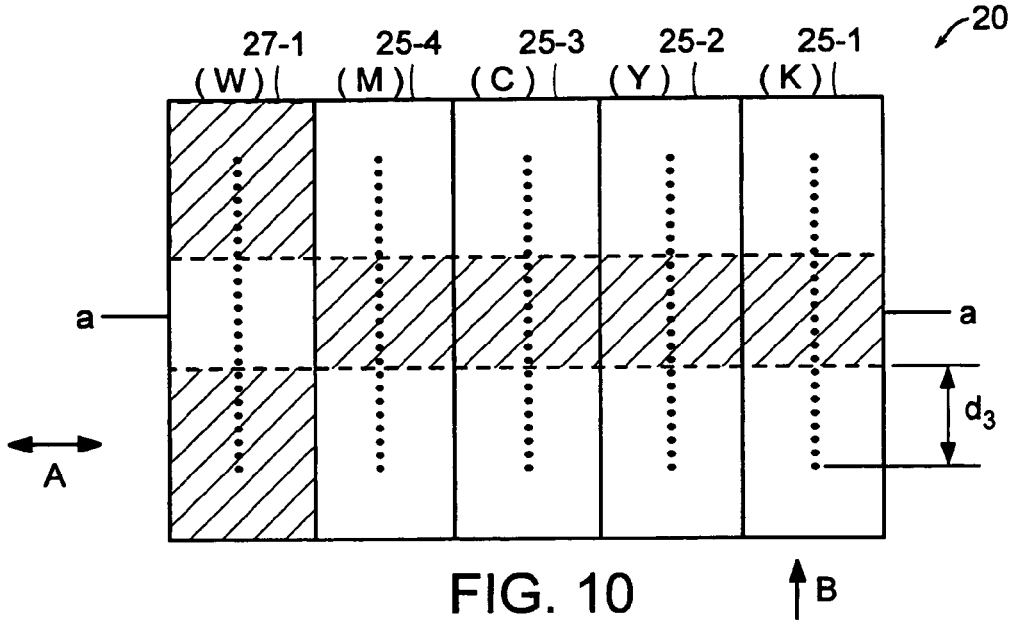
FIG. 10 is a bottom view of a series of print heads schematically illustrating a multi-channel printing mode for printing a backlit sign.
Figure 11:
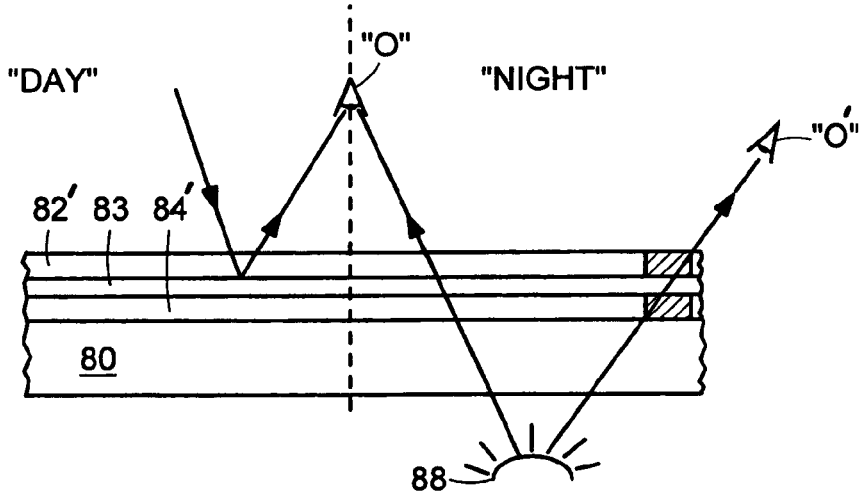
FIG. 11 is a cross-sectional side view of a backlit sign produced according to the printing mode of FIG. 10.
Figure 12:
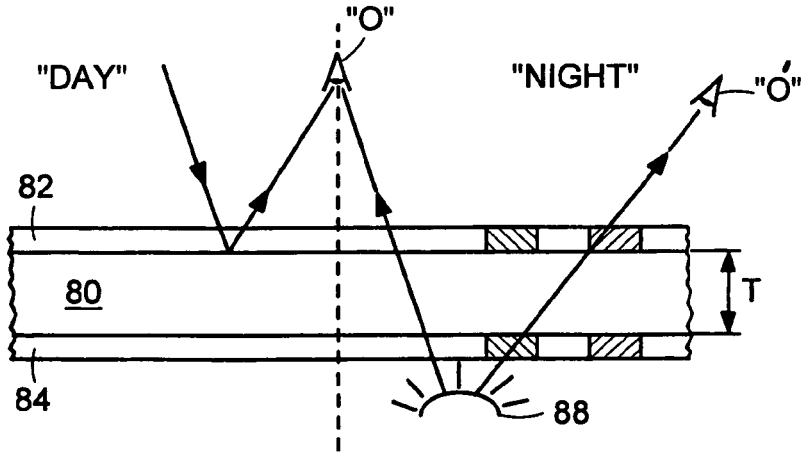
FIG. 12 is a cross-sectional side view of a prior art backlit sign.

FIGS. 10-11 illustrate yet another multi-channel printing mode of the invention that is particularly advantageous for backlit imaging and dual-sided imaging. As shown in FIG. 12, a conventional backlit image typically uses a light-diffuse substrate, such as a white or partially opaque substrate 80 having a first image 82 and a second image 84 printed or laminated on front and rear surfaces, respectively, of substrate 80. First image 82 and second image 84 are typically the same image. During daylight hours, or whenever there is sufficient ambient light, an observer (O) views first image 82 on the front side of the substrate. In contrast, at night, or when there is insufficient ambient light, a backlight 88 shines light through second image 84, first image 82 and light-diffuse substrate 80. If first image 82 and second image 84 are the same image, observer (O) sees a single, composite image.

There are several deficiencies with this type of backlit imaging. First, the first image 82 on the front side of substrate 80 must be precisely aligned and registered with the second image 84 on the back side, or else the backlit image will appear fuzzy or distorted to an observer. Proper alignment of the first and second images may be difficult, for example, if one or both of the images are laminated on substrate 80. Moreover, because substrate 80 has a finite thickness (T), even properly-aligned features of first image 82 and second image 84 will appear fuzzy to an observer (O') who views the backlit image from the side, as illustrated in FIG. 12.

Apparatus and methods in accordance with this invention overcome these deficiencies by providing a multi-channel printing mode for backlit imaging. Referring now to FIG. 10, the underside of the print head carriage 18 of FIG. 2 is now described. In this mode of operation, as carriage 18 scans across a substantially translucent or substantially clear substrate along the direction of arrow A, the controller causes colored ink to eject from the nozzles of the non-hatched regions of color ink print heads 25-1, 25-2, 25-3 and 25-4, and a specialized printing fluid from print head 27, but no ink is ejected from the hatched regions of these heads. Notably, both the leading portion and the trailing portion of the nozzles of the color ink print heads 25 are used for printing color images. In contrast, only the middle portion of the nozzles of the ink print head 27 is used to apply the specialized printing fluid.

For backlit imaging, the specialized printing fluid preferably is translucent to light. One such specialized printing fluid that satisfies this criteria is a substantially white ink. As substrate 80' moves along the direction of arrow B, the leading third of the nozzles of color ink print head 25 (i.e., nozzles 29-17 through 29-24) deposit a first portion of first color image 84' on the substrate. Then, as the carriage scans back across substrate 80' and the substrate is incremented by distance $d_3$ along direction of arrow B, the middle nozzles (i.e., nozzles 29-9 through 29-16) of print head 27 deposit a layer 83 of substantially white ink over the first portion of first image layer 84', and the leading third of nozzles 29-17 through 29-24 of print heads 25 deposit a second portion of first color image layer 84' on the next section of the substrate 80' to pass under the heads.

Next, as the carriage scans again across the substrate 80', and the substrate is again incremented by distance $d_3$, the trailing third of nozzles (i.e., nozzles 29-1 through 29-8) of color print heads 25 deposit a first portion of second color image 82' over both the substantially white coating layer 83 and the first portion of first color image 84', while the middle third of nozzles of print head 27, and the leading third of nozzles of the color print heads 25, deposit a substantially white coating layer and a third portion of first color image 84', respectively. This process is repeated until the entire first image 84' and second image 82' are printed on substrate 80', with the substantially white intermediate coating layer 83 sandwiched between the two color images.

A cross-section of images produced according to this printing mode is shown in FIG. 11. An advantage of this arrangement is that the intermediate layer between the first image 84' and second image 82' consists only of a relatively thin layer of substantially white ink 83, instead of the comparatively thicker substrate 80, as shown in the prior art technique of FIG. 12. Thus, this greatly reduces the problem of "fuzzy" images when a backlit image is viewed from the side. Moreover, because both the first image 84' and second image 82' are formed during the same printing operation, using the same print heads, the two images may be precisely aligned to one another on the substrate, thus eliminating the problem of fuzzy and distorted images as in conventional backlit imaging shown in FIG. 12.

For backlit imaging, first image 84' and second image 82' typically are the same image. Persons of ordinary skill in the art will understand that the process described above for backlit imaging in accordance with this invention also may be used for dual-sided imaging in which the first and second images may be the same image or may be different images. Indeed, if substrate 80' is clear media and intermediate layer 83 is a substantially white ink, an observer (O) may view the first image 84' in ambient light from the non-printed side of substrate 80', and may view the second image 82' in ambient light from the printed side of substrate 80'.

Persons of ordinary skill in the art will understand that although the embodiment of FIG. 10 shows the first and last thirds of the nozzles of the color ink print heads 25-1 through 25-4 as performing the color printing steps, and the middle third of the nozzles of print head 27 as performing the white ink printing steps, these exact percentages are not necessary. What is required for the backlit imaging or dual-sided imaging mode is that a first number of nozzles of color ink print heads 25 are dedicated to printing the first image 84', a second number of nozzles of color ink print heads 25 are dedicated to printing the second image 82', and a third number of nozzles of print head 27 between the first and second number of nozzles are dedicated to printing the specialized print fluid between the first image 84' and the second image 82'.

The foregoing merely illustrates the principles of this invention, and various modifications may be made by persons of ordinary skill in the art without departing from the scope and spirit of this invention.

The invention claimed is:

1. A multi-pass printing method comprising:

printing a first image including a combination of colors on a substantially translucent substrate using a first row of print heads within a printer head carriage during a first pass of the carriage, wherein the first row of print heads contain all the colors necessary to print the first multi-color image, wherein the substantially translucent substrate has a first side and a second side, and wherein the first multi-color image is printed on the second side;

printing an at least partially opaque coating layer over the first multi-color image using a second row of print heads during a second pass of the carriage, wherein the first group of print heads and the second row of print heads are configured in a same printer head carriage, and wherein the at least partially opaque coating layer facilitates quality viewing of the first multi-color image from the first side of the substantially translucent substrate; and printing a second multi-color image over the at least partially opaque coating layer on an opposite side of the coating layer as the first multi-color image using a third row of print heads during a third pass of the carriage, wherein the third row of print heads are configured in a same printer head carriage as the first row of print heads and the second row of print heads, wherein the third row of print heads contain all the colors necessary to print the second multi-color image, and wherein the first, second, and third pass of the carriage results in printed substrate configured such that the first multi-color image is visible when looking through a first side of the substrate and the second multi-color image is visible when looking from a second side of the substrate.

2. The method of claim 1, wherein the coating layer comprises substantially white ink.

3. The method of claim 1, wherein the substrate comprises glass.

4. The method of claim 1, wherein the substrate comprises plastic.

5. The method of claim 1, wherein the first multi-color image and the second multi-color image comprise the same image.

6. The method of claim 1, wherein the first multi-color image and the second multi-color image comprise different images.

7. The method of claim 1, wherein the first row of print heads comprise substantially one third of the print heads in the printer head carriage.

8. The method of claim 1, wherein the second row of print heads comprise substantially one third of the print heads in the printer head carriage.

9. The method of claim 1, wherein the third row of print heads comprise substantially one third of the print heads in the printer head carriage.

10. The method of claim 1, further comprising moving the printer head carriage on an axis in a direction of travel back and forth across the substrate.

11. The method of claim 1, wherein the substrate is adapted for backlit imaging.

12. A printing apparatus comprising:

a first row of print heads within a multi-pass printer head carriage, wherein the first row of print heads contain all the colors necessary for printing a first multi-color image on a substantially translucent substrate during a first forward pass of the multi-pass printer head carriage, the substantially translucent substrate comprising a first side and a second side, and wherein the first multi-color image is printed on the second side;

a second row of print heads within a multi-pass printer head carriage configured for printing an at least partially opaque coating layer over the first multi-color image during a first return pass of the multi-pass printer head carriage, and wherein the at least partially opaque coating layer facilitates quality viewing of the first multi-color image from the first side of the substantially translucent substrate; and a third row of print heads within the multi-pass printer head carriage, wherein the third row of print heads contain all the colors necessary for printing a second multi-color image over the at least partially opaque coating layer on the opposite side of the opaque coating layer as the first multi-color image during a second forward pass of the multi-pass printer head carriage, wherein the second multi-color image is visible when looking from the second side of the substrate, and wherein the apparatus prints on a substrate such that the first multi-color image is visible when looking through a first side of the substrate and the second multi-color image is visible when looking from a second side of the substrate.

13. The apparatus of claim 12, wherein the coating layer comprises substantially white ink.

14. The apparatus of claim 12, wherein the substantially translucent substrate comprises glass.

15. The apparatus of claim 12, wherein the substantially translucent substrate comprises plastic.

16. The apparatus of claim 12, wherein the first multi-color image and the second multi-color image comprise the same image.

17. The apparatus of claim 12, wherein the first multi-color image and the second multi-color image comprise different images.

18. A printing apparatus comprising:

a printer base having a transport belt for feeding a substantially translucent substrate across the top surface of the printer base, wherein the substantially translucent substrate has a first side and a second side; and a carriage coupled to the printer base via a rail system, wherein the carriage is configured for multi-pass traversal of the printer base on the rail system, forward and backward in a direction perpendicular to the direction of the substantially translucent substrate being fed across the printer base, and wherein the carriage further comprises:

a first ultraviolet light source disposed on the right side of the carriage;

a first row of print heads containing ink of all colors required for printing a first multi-color image on the substantially translucent substrate during at least a first forward pass of the carriage across the substantially translucent, and wherein the first multi-color image is printed on the second side of the substantially translucent substrate;

a second ultraviolet light source disposed on the left side of the carriage, wherein the second ultraviolet light illuminates the first multi-color image with ultraviolet radiation as the carriage continues traversal of the substantially translucent substrate during the at least first forward pass, thereby curing the first multi-color image;

a second row of print heads configured for printing an at least partially opaque coating layer over the first multi-color image during at least a first return pass of the carriage across the substantially translucent substrate, wherein the at least partially opaque coating layer facilitates quality viewing of the first multi-color image from the first side of the substantially translucent substrate, and wherein the first ultraviolet light illuminates the at least partially opaque coating layer with ultraviolet radiation as the carriage continues traversal of the substantially translucent substrate during the at least first return pass, thereby curing the first at least partially opaque coating layer; and a third row of print heads containing ink of all colors required for printing a second multi-color image over the at least partially opaque coating layer on the opposite side of the opaque coating layer as the first multi-color image, during at least a second forward pass of the carriage across the substantially translucent substrate, wherein the second ultraviolet light illuminates the second multi-color image with ultraviolet radiation as the carriage continues traversal of the substantially translucent substrate during the at least second forward pass, thereby curing the second multi-color image, wherein the first multi-color image is visible when looking through a first side of the substrate and the second multi-color image is visible when looking from a second side of the substrate.

* * * * *